US005169014A

United States Patent [19]

Hexamer

[11] Patent Number: 5,169,014

[45] Date of Patent: Dec. 8, 1992

[54] LOCKING MEANS FOR DISPLAY PACKAGE

[75] Inventor: Donald K. Hexamer, Hillsdale, Canada

[73] Assignee: Par-Pak Limited, Brampton, Canada

[21] Appl. No.: 777,785

[22] Filed: Oct. 16, 1991

[30] Foreign Application Priority Data

May 31, 1991 [CA] Canada ..... 2043711

[51] Int. Cl.[5] ..... B65D 1/34

[52] U.S. Cl. ..... 220/4.22; 220/306; 229/2.5 R

[58] Field of Search ..... 220/306, 4.72; 229/2.5 R

[56] References Cited

U.S. PATENT DOCUMENTS

| | | | |
|---|---|---|---|
| 3,164,478 | 1/1965 | Bostrom | 99/172 |
| 3,351,270 | 11/1967 | Hohnjec | 229/44 |
| 3,421,682 | 1/1969 | Eisenbach | 229/51 |
| 3,447,731 | 6/1969 | Lehmann | 229/2.5 |
| 3,596,822 | 8/1971 | Holly | 229/15 |
| 3,669,606 | 6/1972 | Brown | 425/398 |
| 3,786,982 | 1/1974 | Rakes | 229/2.5 |
| 3,933,296 | 1/1976 | Ruskin | 229/2.5 |
| 4,243,140 | 1/1981 | Thrun | 206/380 |
| 4,494,650 | 1/1985 | Cullen | 206/45.34 |
| 4,512,474 | 4/1985 | Harding | 206/461 |
| 4,576,330 | 3/1986 | Schepp | 229/44 R |
| 4,771,934 | 9/1988 | Kalmanides | 229/2.5 R |
| 4;886,204 | 12/1989 | Kalmanides | 229/2.5 R |

FOREIGN PATENT DOCUMENTS

| | | |
|---|---|---|
| 1249231 | 1/1989 | Canada . |
| 1580011 | 4/1970 | France . |
| 2456495 | 4/1979 | France . |
| 6607668 | 12/1966 | Netherlands . |
| 1418897 | 12/1975 | United Kingdom . |
| 2118142 | 10/1983 | United Kingdom . |

*Primary Examiner*—Joseph Man-Fu Moy
*Attorney, Agent, or Firm*—Riches, McKenzie & Herbert

[57] ABSTRACT

An improved locking arrangement for blister packaging in which a male element with an enlarged head is received in snap lock engagement in a female element past a reduced annular shoulder in the female element. The male element has its head enlarged about a circumferential segment, preferably not greater than 270° so as to facilitate entry of the male element into the female element without reducing the forces required for unlocking yet permitting the male element to be sufficiently strong to resist crushing on the application of axial finger pressures to the male element on manual closing of the packaging.

17 Claims, 5 Drawing Sheets

FIG. 16
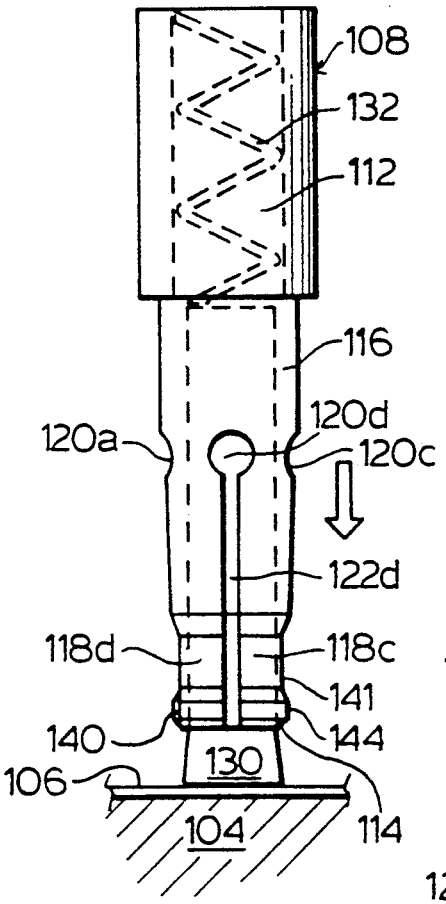
FIG. 17
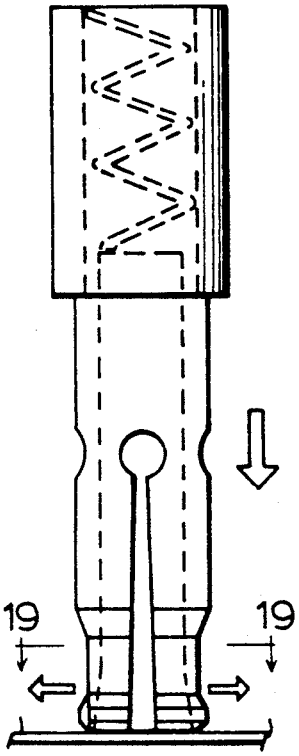
FIG. 18
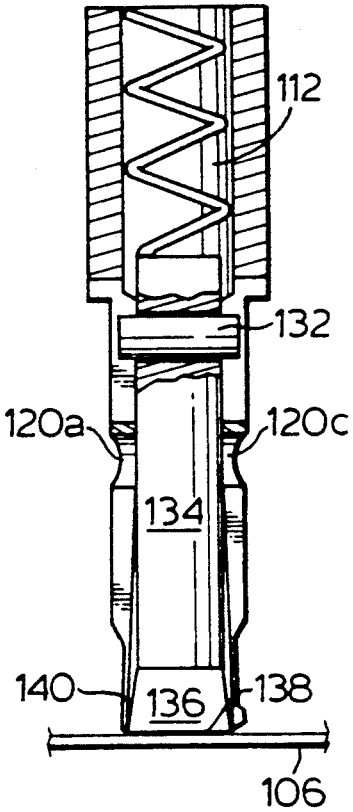
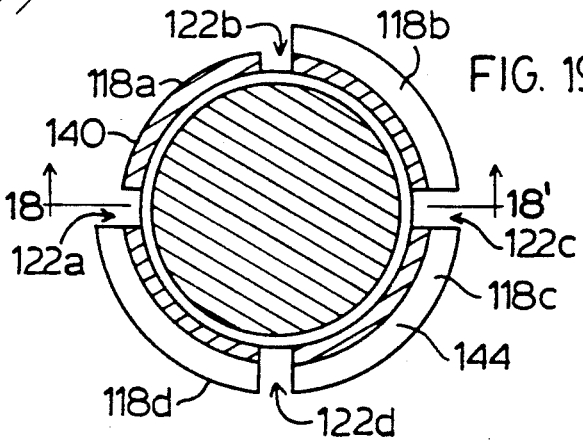
FIG. 19

LOCKING MEANS FOR DISPLAY PACKAGE

SCOPE OF THE INVENTION

This invention relates to an improved arrangement for locking a package, notably, blister packaging. The invention more particularly is directed to a novel arrangement of interlocking male and female elements to releasably close a package.

BACKGROUND OF THE INVENTION

Plastic packaging for exhibiting a wide variety of articles are well-known and various arrangements are known to secure the packages closed. For example, U.S. Pat. No. 3,786,932 to Rakes et al, issued Jan. 22, 1974; U.S. Pat. No. 4,512,474 to Harding, issued Apr. 23, 1985 and U.S. Pat. No. 4,576,330 to Schepp, issued Mar. 18, 1986 all show plastic packaging and locking arrangements in which male elements are received in forcefit or snap engagement within a female element. The arrangement of Rakes, Harding and Schepp all suffer the disadvantage that it is difficult to form the male and female elements so as to have a resiliency to permit snap lock insertion of the male element into the female element and provide the male and female elements with sufficient strength to avoid crushing of the male or female elements during a manual closing operation in which finger and/or thumb pressure is applied to the axial end of male and female elements. This disadvantage is recognized by U.S. Pat. No. 4,771,934 to Kalmandies, issued Sep. 20, 1988 which proposes, as a solution, the protection of an upstanding female element from crushing by providing protective upstanding lands on either side of a female element. Kalmandies has a disadvantage of requiring a more complex mould and of having a structure which is not readily adapted for closing by automated machines.

The male and female arrangements taught by Harding, Schepp and Kalmandies all utilize male elements with enlarged head portions. These enlarged head portions have the disadvantage that they are difficult to manufacture. None of these patents disclose a practical method of manufacturing the male element to provide a consistently formed enlarged head portion.

SUMMARY OF THE INVENITON

Accordingly, it is an object of the present invention to at least partly overcome these disadvantages of the prior art by providing an improved arrangement of interlocking male and female elements which permit increased locking forces and improved resistance to crushing. It is another object to at least partially overcome the disadvantages of the prior art by providing an improved method and apparatus for thermo-forming polymeric material to provide male elements with enlarged head portions.

Another object of the present invention is to provide a configuration for interlocking male and female elements which can be accurately created so as to control the forces required to unlock the male element from the female element.

An object is to provide a package having a locking arrangement which provides a tamper-evident lock disengageable only under sufficient force to tear the plastic material forming the package.

Accordingly, in one aspect, the present invention provides a thermo-formed container comprising first and second sheet portions of a thermo-formable thermoplastic polymeric material, at least one of said first and second sheet portions having a packaging cavity therein, said first sheet portion having a tubular female element with an open end, an end wall and a side wall having female catch means arranged circumferentially thereabout extending inwardly therefrom, said second sheet portion having a tubular male element with an end wall and a side wall having male catch means arranged circumferentially thereabout extending outwardly therefrom;

the male element and female element being complimentary shaped with the female element adapted to receive the male element through the open end thereof with said male catch means in snap engagement past the female catch means with said female catch means and male catch means to engage to resist withdrawal of the male element from the female element, the female catch means and male catch means engaging each other with greatest interference over a major circumferential sector having a circumferential extent of at least 180°, a lesser circumferential sector diametrically opposite the major circumferential sector having reduced engaging interference between the male element and the female element compared to the major circumferential sector such that on insertion of the male element into the female element there is reduced resistance to the male element entering the female element over the lesser circumferential sector as compared to the major circumferential sector and, on insertion, at least one of the male element and the female element axially deflect relative to the other such that the male element moves towards the lesser circumferential section to facilitate the male catch means passing the female catch means.

In another aspect, the present invention provides a package of the type made by thermo-forming synthetic resin thermoplastic material into a pair of sections adapted to close one upon the other in order to retain an object in a chamber formed therebetween, and having fastening means for securing the sections together, the improvement wherein said fastening means comprise resiliently engaging male element and female element, respectively, integrally formed with said package sections, said female element being generally cylindrical with an open end, an end wall and a generally cylindrical side wall having female catch portions arranged circumferentially thereabout extending inwardly therefrom, said male element being substantially cylindrical with an end wall and a generally cylindrical side wall having male catch means arranged circumferentially thereabout extending outwardly therefrom, the female element adapted to receive the male element through the open end thereof with said male catch means in snap engagement past the female catch means with said female catch means and male catch means to engage to resist withdrawal of the male element from the female element, wherein to facilitate passage of the male catch means past the female catch means on inserting the male element into the female element, the male element having a lesser circumferential segment provided without said male catch means extending over a continuous circumferential extent of at least 90°.

An improved locking arrangement for blister packaging in which a male element with an enlarged head is received in snap lock engagement in a female element past a reduced annular shoulder in the female element. The male element has its head enlarged about a circumferential segment, preferably not greater than 270° so as to facilitate entry of the male element into the female element without reducing the forces required for unlocking yet permitting the male element to be sufficiently strong to resist crushing on the application of axial finger pressures to the male element on manual closing of the packaging.

Providing increased interference between the male and female elements over only a major segment of the elements circumference assists entry of the male into the female as by deflection of one or both of the elements toward the lesser segment having by comparison reduced interference. The interference between the male and female over the major circumferential segment can provide adequate resistance to unlocking and, if desired, sufficient resistance for a tamper-evident seal.

The invention also provides an improved structure for a mold element to form male and female elements with enlarged end portions in conventional thermoforming apparatus by providing the mold element with radially moveable segments coupled to wedge-like camming elements which cam the segments radially on closing of the mold plate of the mold. By providing the camming elements with an activating end for contact with an opposed mold plate on closing, the mold element may be easily provided in conventional thermoforming apparatus.

BRIEF DESCRIPTION OF THE DRAWINGS

Further objects and advantages of the present invention will become apparent from the following description taken together with accompanying drawings in which:

FIGS. 16 and 17 are side elevational views of an expandable mold element of the apparatus of FIGS. 14 and 15 for use in forming male elements of the package of FIG. 1, in extended, collapsed and retracted, expanded positions, respectively;

FIG. 18 is a cross-sectional side elevational view of the mold element along line 18—18' of FIG. 19;

FIG. 19 is a cross-sectional plan view through the mold element of FIG. 17 along line 19—19';

DETAILED DESCRIPTION OF THE DRAWINGS

Reference is now made to the drawings in which like numerals indicate like elements.

Figure 1:
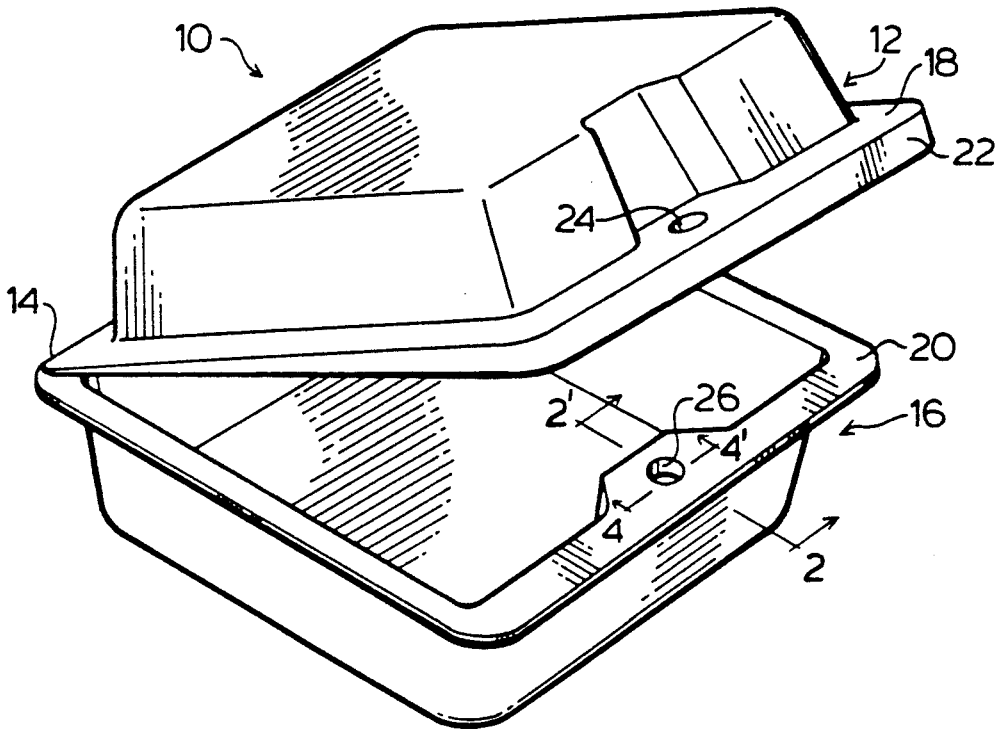
FIG. 1 is a pictorial view of one package in accordance with the invention.

Referring first to FIG. 1, a package generally indicated 10 is of the type thermo-formed in a mold cavity in one piece to have a lid 12 hinged along hinge line 14 directly to a tray 16. The lid 12 and tray 16 each have a packaging cavity formed therein.

Lid 12 has a horizontal flange 18 around its periphery adapted to be seated on a horizontal flange 20 provided about the periphery of tray 16. Flange 18 has a downturned lip 22. The relative size of the flanges 18 or 20 are such that lid 12 can be held with its flange 18 in sealing engagement on flange 20 of tray 16 when the lid is positioned to close the tray.

A locking arrangement is provided by a male element 24 provided on the flange 18 of the lid, extending downwardly therefrom and a female element 26 formed on a corresponding location on flange 20 of tray 16. The male element 24 is adapted to be received within the female element 26 in snap engagement to securely lock the lid 12 to the tray 16.

The specific constructions of the female element 26 and male element 24 are now described.

Female element 26 is of a generally cylindrical shape and has an open end 28, an end wall 30 and a generally cylindrical side wall 32. Female element 26 is shown as symmetrical about its axis Af. Female wall 32 is formed with an annular shoulder generally indicated 34 which provides, in the interior 36 of the female element, a reduced radius portion having a radius Rfc which is smaller than the interior radius Rfw of the cylindrical portion of the wall 32. Annular shoulder 34 forms, in effect, on the interior surfaces of the wall, female catch surfaces 38 directed towards the end wall 30 and female chamferred cam surfaces 40 directed away from the closed end 30.

Figure 6:
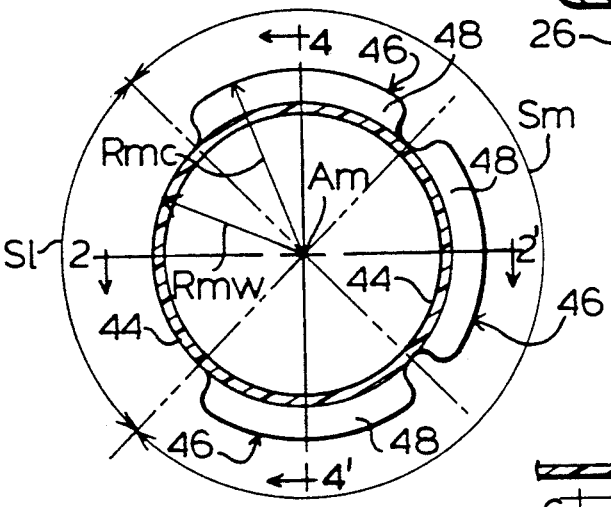
FIG. 6 is a cross-sectional plan view of the male element along line 6—6' of FIG. 5.

Male element 24 is also of a generally cylindrical configuration and has an end wall 42 and a generally cylindrical side wall 44. As best seen in FIG. 6, the male element 24 is not symmetrical about its axis Am. The side wall is provided with three protrusions 46 which extend outwardly from the cylinder otherwise to be formed by the side walls. As seen, the protrusions have a radius indicated as Rmc which is greater than the radius Rmw of the remaining portions of the cylindrical side wall. Each protrusion 46 is shown as being located within a 90° segment such that in totality the three segments extend cooperatively over a major circumferential sector indicated as Sm of about 270°. This leaves a lesser circumferential sector S1 extending circumferentially an extent of about 90° where the wall does not have any protrusions.

Each protrusion 46 extends outwardly from the side wall 44 so as to present male catch surfaces 48 on the exterior of the male element directed away from the end wall 42.

Figure 3:
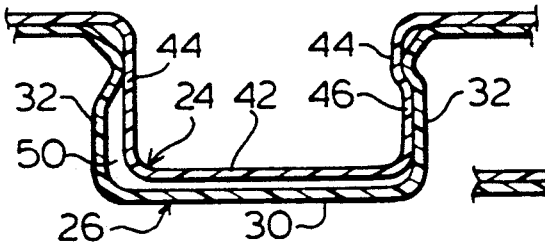
FIG. 3 is a cross-sectional side view along line 2—2' showing the male and female elements in a locked position.
Figure 4:
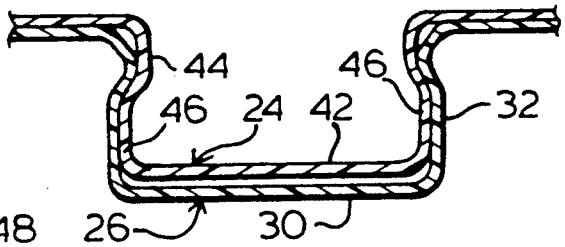
FIG. 4 is a cross-sectional side view along line 4—4' of FIG. 1 showing the male and female elements in a locked configuration.

FIGS. 3 and 4 show the male element 24 and female element 26 locked together. FIG. 3 shows a cross-section along line 2—2′ which includes the lesser circumferential sector S1 in which no protrusion 46 is formed. FIG. 4 shows a cross-section along line 4—4′ which does not pass through the lesser circumferential sector S1. As may be seen, in the locked configuration of both FIGS. 3 and 4, the male catch surfaces 48 abut and engage the female catch surfaces 38 so as to resist withdrawal of the male element 24 from the female element 26. As seen in FIG. 4, the side wall 44 of the male element 24 conforms closely to the shape of the side wall 32 of the female element over the male catch surfaces 48 and over the radially outer surfaces of the protrusions 46. In contrast, as seen in FIG. 3, a space 50 is formed between the inside surface of the cylindrical wall 32 of the female element and the side wall 44 of the male element over the lesser circumferential sector S1 where the side wall 44 of the male element does not have protrusions 46 and is of the radius Rmw.

Package 10 is formed so that when the male and female elements are locked together, the axis of the male element 24, Am, and the axis of the female element 26, Af, coincide.

Figure 9:
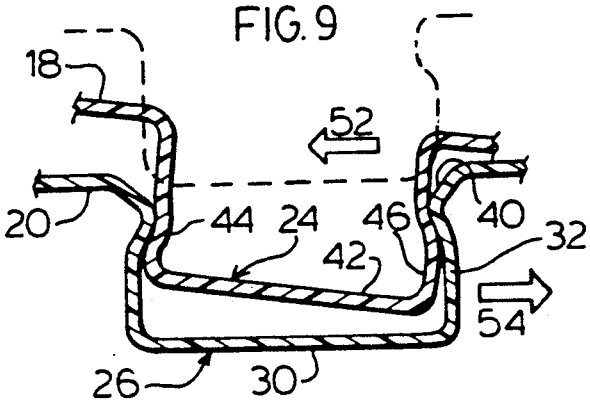
FIG. 9 is a cross-sectional side view similar to that of FIG. 4 along line 2—2' of FIG. 1 and schematically showing deflection of the male and female element by insertion of the male element into the female element.

Reference is now made to FIG. 9 which assists understanding the manner in which the male element 24 and female element 26 interact on insertion of the male element into the female element. FIG. 9 shows a cross-section along line 2—2′ through the lesser circumferential sector S1. On the male element being forced into the female element, as seen in FIG. 9 in dotted lines, there is less resistance to the male element entering the female element along the lesser circumferential sector S1 as compared to the resistance to the male element entering the female over the major circumferential sector Sm. This arises in that it is over the major circumferential sector Sm that the protruberances 46 on the male element 24 contact and interfere with the female cam surfaces 40 of the female element 26. Due to this decreased resistance, the male element tends to enter the female element over the lesser circumferential sector S1 before it enters the major circumferential sector Sm. At the same time, the female cam surfaces 40 tend to deflect male element 24 to the left as indicated by arrow 52 in FIG. 9. Female element 26 may be, to some extent, counter-deflected to the right as indicated by arrow 54. In effect, the male and female elements tend to become somewhat tilted relative to their axis and each other as shown by the exaggerated angulation of the end wall 42 of the male element compared to the end wall 30 of the female element in solid lines in FIG. 9. This tilting may take place by reason of the package comprising somewhat resilient materials. For example, the flanges 18 and 20 carrying the male and female element are resilient as are the male and female elements themselves. The relative tilting of the male and female elements assist in reducing the forces necessary for the protrusions 46 to pass by the annular shoulder 34 of the female element. Once the protrusions 46 have cleared the annular shoulder 34, the male and female elements realign coaxially to adopt a configuration as seen, for example, in FIGS. 3 and 4 with the male and female catch surfaces 38 and 48 blocking the male element against withdrawal.

The preferred embodiment shows the lesser circumferential sector S1 as having a circumferential extent of about 90° and the major circumferential sector Sm as having a circumferential extent of about 270°. The circumferential extent of the lesser circumferential sector S1 needs to be sufficiently large having regard to the resiliency and configuration of the male and female elements to assist in them deforming and deflecting axially so that the protrusions 46 pass the annular shoulder 34. Preferably, the circumferential extent of the lesser circumferential sector S1 will be at least 90° as shown. The major circumferential sector Sm is preferably the remainder of the circumferential extent although this is not necessary. The major circumferential sector represents the circumferential extent over which the female catch surfaces will engage the male catch surfaces. It is to be appreciated, however, that it is not necessary that there be engaging male catch surfaces and female catch surfaces over the whole of the major circumferential sector. For example, the plurality of smaller protrusions could be provided to replace the three protrusions 46. The protrusions 46 could be replaced by a number of projections each with a relatively small circumferential extent and spaced circumferentially from each other a circumferential extent less than that of the lesser circumferential sector, i.e., preferably less than 90°.

The lesser circumferential sector may, in the simplest sense, comprise a sector between the male and the female in which there is reduced resistance to the male element entering the female element as compared to the major circumferential sector where there is greater resistance to the male element entering the female element. This reduced resistance could be provided by the lesser circumferential sector having reduced engaging interference between the male element and the female element as compared to the major circumferential sector. On insertion, the male element and/or female element axially deflect in relation to one another such that the male element moves towards the lesser circumferential section to facilitate the male element entering the female element.

Figure 5:
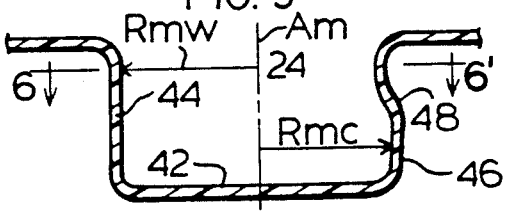
FIG. 5 is a cross-sectional side view of the male element only along line 2—2' of FIG. 1.
Figure 8:
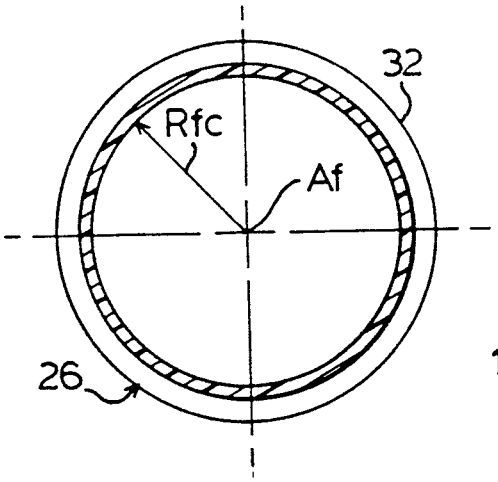
FIG. 8 is a cross-sectional plan view of the female element along line 8—8' of FIG. 7.
Figure 7:
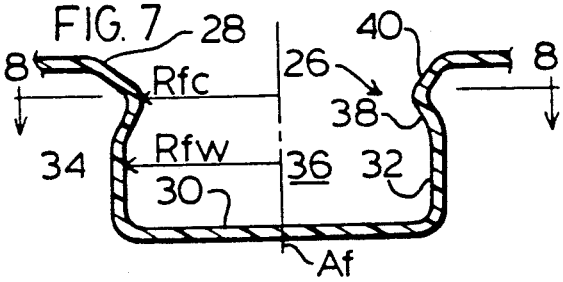
FIG. 7 is a cross-sectional side view of the female element only along line 2—2' of FIG. 1.

FIGS. 5 and 7 conveniently show the radii of the various components of the male and female elements in accordance with the preferred embodiment. While not being limited to the preferred embodiment, it is to be appreciated that the inside radius Rfc of the annular shoulder 34 is less than the external radius Rmc of the protrusions 46. It is preferable that the internal radius Rfc of the annular groove 34 is equal to or only marginally greater than the radius Rmw of the cylindrical portion of the male wall such that as seen in FIG. 3, the annular groove 34 may assist by contact with the wall of the male element in retaining the male element roughly axially centered within the female element. Preferably, the radius Rmc of the protrusions 46 is equal to or about the same as the radius Rfw of the cylindrical portion of the female side wall.

The preferred embodiment shows the external surfaces of the side walls of the male element in substantially continuous coextensive contact with the internal surfaces of the side walls of the female element from the male catch surfaces 48 to near the male end wall 42. A small gap is provided between the male end wall 42 and the female end wall 30 so as to prevent the male end wall from bottoming out into the female end wall 30.

While not clearly shown in the drawings, it is preferred if the side wall 32 of the female element 26, rather than being purely cylindrical between the female catch surfaces 38 and the female end wall 30, reduces slightly in radius towards the end wall 30 as, for example, by having a slight positive draft of, say, between 10 and 2%. This slight tapering of the female side wall can be of assistance such that insofar as the protrusions 46 on the male element have a radius Rmc substantially equal to the radius of the female side wall Rfw immediately beyond the annular shoulder 34, the female side wall 32 will tend to urge the male element out of the female element and, thus, force the male catch surfaces 48 positively into engagement with the female catch surfaces 38. A positive draft of about 2% typically may be obtained by providing a female mold element to form the female element with a purely cylindrical side wall.

Figure 10:
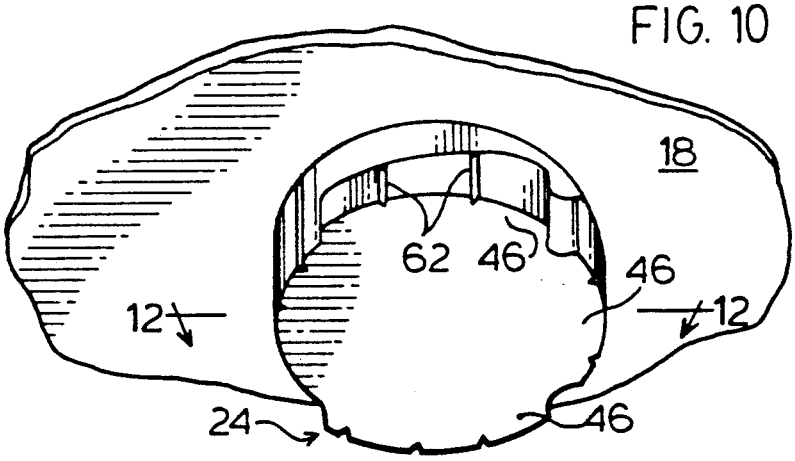
FIGS. 10 and 11 show second embodiments of the female element and male element, respectively, similar to the female element and male element shown in FIGS. 1 to 9.
Figure 11:
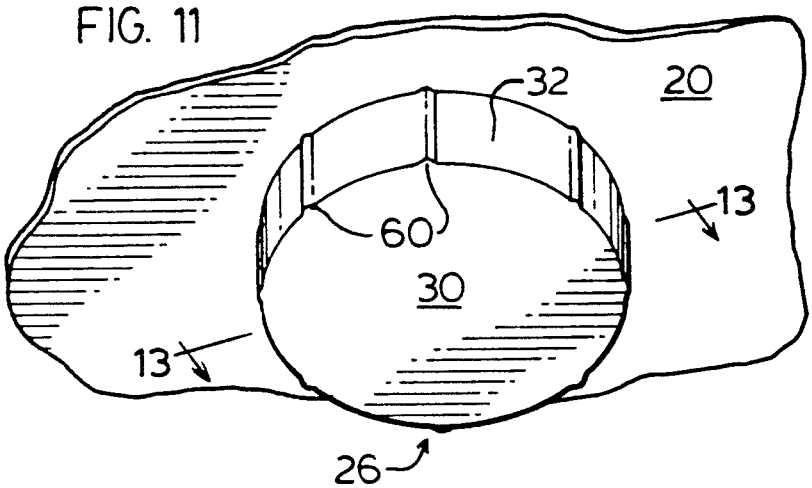

Reference is now made to FIGS. 10 and 11 which show second embodiments of the male and female elements substantially the same as the first embodiment, however, differing in two notable manners. Firstly, axial flutes are provided on each of the male and female elements. Secondly, the male and female catch surfaces are disposed in a plane tipped at an angle to the axis of the male and female elements. In FIG. 11, axial flutes indicated as 60 are provided circumferentially spaced about the female element. On the male element, flutes, indicated as 62, extend fully through the protrusions 46 and at least partially into the cylindrical side wall 44. These flutes have some advantage in strengthening each of the male and female elements. The flutes are axially extending, radially inwardly directed grooves.

Figure 12:
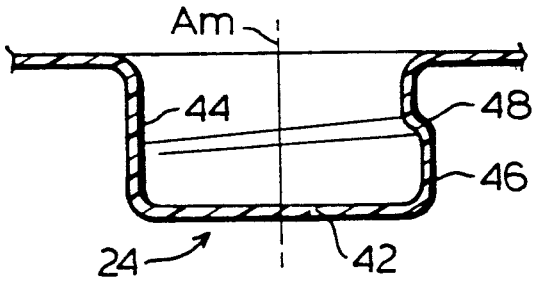
FIG. 12 shows a cross-sectional side view through the male element of FIG. 10 along line 12—12'.
Figure 13:
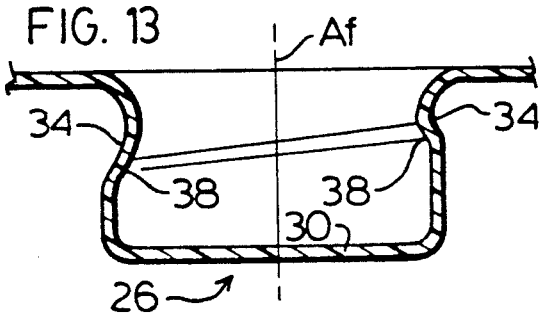
FIG. 13 shows a cross-sectional side view through the female element of FIG. 11 along line 13—13'.

FIGS. 12 and 13 show cross-sectional side views of the male and female elements of FIGS. 11 and 12, respectively. As most notably seen with the female element, the annular shoulder 34 is located in a plane which is not normal to the central axis Af but rather is tipped at an angle thereto with the annular shoulder 34 being closest the closed end wall 30 of the female element in the middle of the lesser circumferential sector S1. Similarly, on the male element, the protrusions 46 are provided with male catch surfaces 48 located in a plane tilted at the same angle to the axis Am of the male element with this plane closest the male end wall 42 in the middle of the lesser circumferential sector. This circumferential angulation of the male and female catch surfaces is believed to assist in increasing the forces required to withdraw the male element from the female element. The angulation of the male and female catch surfaces will serve to cam the male element on the angled female catch surfaces diametrically away from the lesser circumferential sector and, thus, more positively into the major circumferential sector where there is greatest engaging interference between the male element and the female element. As well, insofar as the female cam surfaces 40 are disposed on the underside of the annular shoulder 34, this is of assistance when inserting the male element intending to deflect the male element towards the lesser circumferential section.

While the embodiments of FIGS. 10 to 13 show the entirety of the male catch surfaces and female catch surfaces disposed in a plane tilted at an angle to the axis, it is to be appreciated that only complementary portions of each could be disposed in such a plane with other portions disposed at an angle in another plane or in a plane perpendicular o the axis. Similarly, the female cam surfaces 40 or segments thereof may be disposed in a plane disposed at an angle to the axis to assist tilting on insertion of the male element although the female catch surfaces have a different orientation. In discussing the angulation of the male and female catch surfaces as shown in FIGS. 10 to 13, this is to be understood as providing, for example, the annular shoulder 34 in the female element 26 to extend circumferentially about the female element with the center of the shoulder 34 disposed in a plane which is tilted at an angle to the axis of the female member. Of course, as seen in the cross-sectional views, the annular shoulder 34 has in both embodiments of FIGS. 2 to 9 and FIGS. 11 to 13, at any location, female catch surfaces 38 and female cam surfaces 40 which are tilted to the axis to be directed toward or away from the end wall 30.

The preferred embodiments show male and female elements having generally cylindrical configurations. This is preferred particularly from the point of view of conveniently producing the necessary tooling for the molds to form the male and female elements. However, other shapes may be utilized such as polygonal shapes, ovals and eclipses, cylinders having straight cords on one or more sides thereof and the like. The male and female elements may or may not taper.

The relative shape and size of the male and female elements will have a bearing on the extent to which a lesser circumferential sector will need to be provided and, with respect to shapes such as rectangular, it may be that the provision of the lesser circumferential sector along substantially the entirety of one side of the rectangle or other polygon may be sufficient whether or not this lesser circumferential sector meets the preferred criteria with a cylindrical shape of encompassing at least 90°. The male and female elements may be complementary shapes but need not be of the same configuration. For example, one of the male or female elements could be polygonal and the other could be cylindrical, oval or a truncated cylinder.

The lesser circumferential sector could be provided merely by a substantial space between the male and female elements over the lesser circumferential sector. The preferred embodiment shows the lesser circumferential sector having reduced engaging interference between the male element and the female element by reason of the male element not being provided with a protrusion 46 over that sector. It is to be appreciated that in the preferred embodiment, the protrusions 46 could be provided about all four quandrants of the male with the lesser circumferential sector provided in the same location by eliminating the annular shoulder 34 on the female element over this same sector S1.

By reason of either of the relative tilting of the male and female elements and/or the sequential deformation of the male and female elements to permit the male element to be inserted into the female element in accordance with the present invention, male and female element configurations can be selected so as to have very substantial forces required for withdrawal of the male element yet still permitting practical insertion of the male into the female. This is particularly advantageous where a tamper-evident locking seal is desired. In this case, the female/male catch surfaces are designed to engage with sufficient resistance to withdrawal of the male that forces must be applied greater than that which the plastic sheeting will withstand. In this event, on attempting to open the container, the male and female elements will not become disengaged but rather the package will be torn or ripped thus providing visual evidence of tampering. Providing a weakened strength area about either the male or female element can enhance the tearing of the plastic although this is not necessary.

Figure 14:
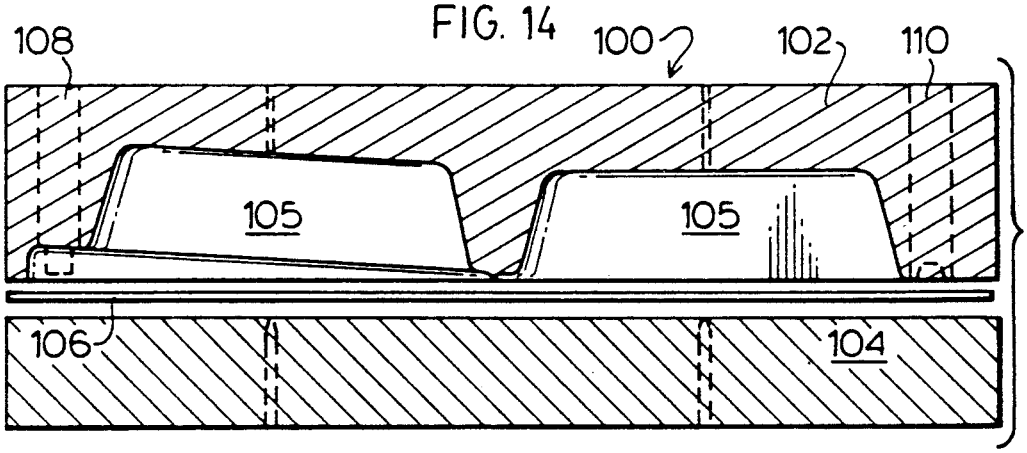
FIGS. 14 and 15 are schematic cross-sectional views of a molding apparatus for thermo-forming the plastic package of FIG. 1 from a thermoplastic sheet, in open and closed positions, respectively.
Figure 15:
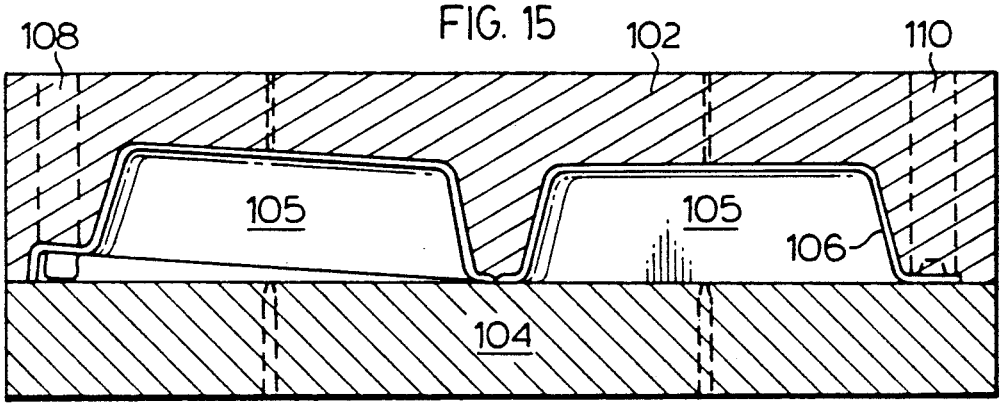

Reference is now made to FIGS. 14 to 20 which show an apparatus for thermo-forming the package of FIG. 1 from a thermoplastic sheet. FIGS. 14 and 15 show the apparatus generally indicated 100 as schmatically including an upper mold plate 102 and a lower mold plate 104 which are moveable vertically towards and away from each other between the open position of FIG. 14 and the substantially closed position of FIG. 15. As is well-known, the mold plates are opened and closed in a molding cycle including, in sequence, inserting flat plastic sheet to be thermo-formed, closing the mold, thermo-forming the sheet with the mold closed, opening the mold, ejecting and removing the molded article and, again, inserting the plastic sheet.

The mold plates 102 and 104 are shown only schematically as their construction is well-known. Lower mold plate 104 is shown as a single plate, however, typically would comprise lower aperture heater plate topped by a aperture diffusion plate. Upper mold plate 102 is also typically shown as a one-piece element, however, typically would include an upper base plate, aluminum casting forming the mold cavity and a hardened cutting edge tool circumferentially about the mold cavity. In operation as is known, continuous plastic sheet 106 from a roll is passed between the mold plates when they are open as in FIG. 14. The mold plates then closed such that the cutting edge cuts into the plastic sheet sufficient to form a seal yet without cutting through the sheet. The sheet is rendered plastic by heat from the lower plate. Pressurized air is applied from the lower plate under the sheet to force it to conform to the contours of the mold cavities 105. Next, the mold plates are fully closed so that the cutting edge cuts through the plastic sheet. The mold is opened with the article formed urged downwardly from the upper plate. The plastic sheeting is advanced sideways out of the opened mold thereby also moving in new plastic sheeting.

FIGS. 14 and 15 schematically show the location of a male mold element 108 and a female mold element 110 for forming the male element 24 and the female element 26, respectively, of the package of FIG. 1.

FIGS. 16 to 19 best show male mold element 108 as comprising an elongate generally cylindrical member with a central cylindrical bore 112 open at a lower end 114. Cylindrical side walls 116 of mold element 108 are divided into four arms 118*a–d* by four radially extending holes 120 *a–d* and respective slots 122*a–d* cut from the lower end to their respective hole 120.

A wedge member 130 is axially slideable within the bore 112 and biased by spring 132 out of the lower end 114 of the bore as seen in FIG. 16. A cross-pin 132 fixed in a hole through the wedge member 130 and slideable in blind ended slots in the opposite sides of side walls of the element 108 serve to stop the wedge member 130 at a fully extended position as seen in FIG. 16 under the bias of spring 132. Wedge member 130 has a generally cylindrical upper portion 134 of a diameter less than that of bore 112 and a lower flaring, wedge portion 136 increasing in diameter from less than that of the bore 112 to greater than that of the bore at its lower end 138.

On the upper mold plate 102 moving downwardly towards the mold plate 104 on closing the mold, lower end 138 of wedge member 130 contacts the plastic sheet 106 supported on the lower plate 104 and is forced upwardly into the bore 112 against the bias of spring 132 to a retracted position as shown in FIG. 17. In movement of the enlarged diameter wedge portion 136 into the bore, the wedge portion 136 engages and in a cam-like manner forces each of the arms 118 radially outwardly to a circumferentially increased position as seen in FIG. 17.

Element 108 is made from a resilient material, preferably spring steel and designed such that arms 118 are resiliently deformable by bending so as to move their lower end radially away from the axis of the bore by flexing of the reduced thickness portion of the side wall 116 between the holes 120. The arms have a memory such that they have an inherent bias to return to the circumferentially reduced position as seen in FIG. 16. To the extent the arms may have sufficient resiliency, it may be possible that the spring may be eliminated, although the spring is of substantial assistance in ejecting the formed package.

When the arms 118 are in the extended position as seen in FIG. 17 with the wedge member 130 retracted, the outer surfaces of the arm 118 provide a configuration serving as a mold element about which the plastic sheet 106 may be thermo-formed so as to provide a desired male element 24 with an enlarged head. In this regard, arm 118*a* is shown to have a cylindrical outer surface over a lower portion 140. In contrast, arms 118*b,c* and *d* have a similar cylindrical portion 144, however, interrupted at its end by a radially outwardly extending part annular boss 144. It is to be appreciated that the surfaces 140, 141 and 142 are to be chosen so as to provide the desired contour for the male element.

In the molding process, after the plastic sheet has been molded about the mold element 108, on opening of the mold, the spring 132 biases the wedge member 130 out of the bore with the result that the arms, coupled to the wedge element, move radially inwardly towards a retracted position. The radial inward movement of the arms and particularly the radially extending bosses on the arms 118*b,c* and *d*, permits the male element 24 to be withdrawn from about the male mold element 108.

FIGS. 16 to 19 show a preferred embodiment of the male mold element 108 with arms 118 formed as integral part of the mold element. It is to be appreciated that arms could be provided which are short segments of an annular ring which may be expanded directly radially outwardly by cam engagement with the wedge member. Provision of a wedge member with a lower end 138 to engage the opposite mold plate and activate the radial expansion of the male mold element is greatly advantageous in avoiding the need to provide more complicated coupling arrangements to control the movement of the wedge member and/or arm relative to the opening and closing of the mold.

Figure 20:
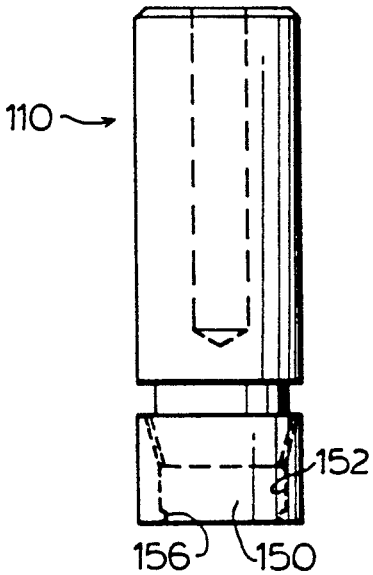
FIG. 20, on the sheet with FIG. 14, is a schematic elevational view of a first embodiment of a female mold element for the apparatus of FIGS. 14 and 15 for use in forming the female element of the package of FIG. 1.

Reference is now made to FIG. 20 which shows a female mold element 110 having a mold cavity generally indicated 150 with an inner cylindrical portion 152 and a reduced radius radially inwardly extending annular boss 156. The annular boss is provided to extend inwardly from the larger cylindrical wall 152 by distance sufficient that resiliency of the thermo-formed plastic sheeting permits withdrawal of the female element 26 from the female mold element 110.

Figure 21:
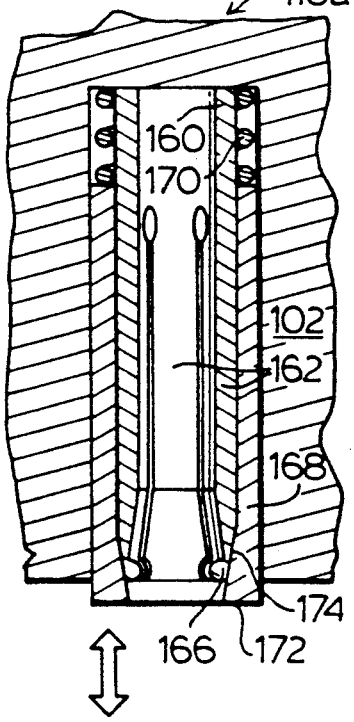
FIG. 21, on the sheet with FIG. 14, is a cross-sectional plan view of a second embodiment of a female mold element for the apparatus of FIGS. 14 and 15.

As an alternate configuration to form the female element 26 with an increased annular rim, a structure may be devised similar to that shown in FIGS. 16 to 19 but, however, with the arms having a radially inwardly extending bosses on their radial inside surfaces and with the wedge element comprising a cylindrical ring radially about the arms and spring biased downwardly in a similar manner. Camming surfaces would be provided between radially inner surfaces of the wedge and radially outer surfaces of the arm such that on the lower end of the wedge being pushed upwardly by the lower mould plate, the wedge would urge the arms radially inwardly. One embodiment of such an alternate configuration is schematically shown as 110*a* in FIG. 21 in which resilient arm carrying element 160 is secured to mold plate 102 and is a split hollow tube having four spring arms 162 formed similar to arms 118 of male mold element 108. Arms 162 have radially inwardly extending bosses 166. Wedge member 168 is a cylinder radially about the arm carrying element 160. Wedge member 168 is axially slidably and biased by spring 170 to an extended position. Wedge member 168 carries at its lower end 172 a frusto-conical section 174 which decreases in radius towards the lower end 172. On the lower mold plate 104 pushing the end 172 of a wedge upwardly, the frusto-conical surfaces of wedge member 168 contact the radially outer surface of the arms 162 and cam them inwardly to a radially inward position forming a female cavity with the bosses 166 to form the annular groove 34 of the female element. On opening of the mold, the arms 162 spread apart, facilitating removal of the thermo-formed female element 26.

Figure 2:
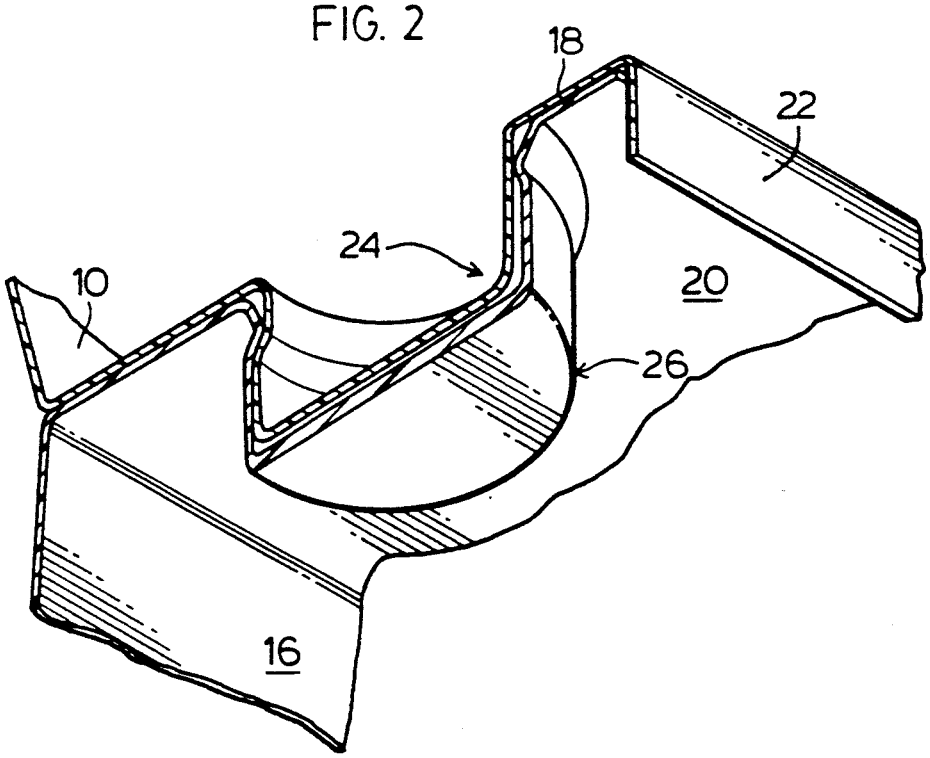
FIG. 2 is an exploded partially cut-away pictorial view of the package of FIG. 1 along a line marked 2—2' showing the male and female elements in a closed, locked position.

Blister packaging similar to that shown in FIG. 1 with male elements and female elements of FIG. 2 have been made from thermoplastic plastic sheeting of biaxially oriented polystyrene of 10/1000 inch thickness using an apparatus shown in FIG. 14 with a male mold element of FIG. 16 and a female mold element of FIG. 20.

In configurations in which the male element 24 had a diameter of roughly ⅜ inches, where the male mold element 108 and female mold element 110 were designed to provide Rfc less than Rmc by about 50/1000 of an inch or greater, the male element 24 could readily be inserted into the female element 26, however, to withdraw the male element resulted in the package tearing in the flanges about the male and female element. When Rfc was provided to be less than about 50/1000 and preferably in the range of about 15/1000 to 35/1000 of an inch, the male element readily entered the female element, provided excellent locking, and could be withdrawn without tearing the packaging.

While the invention has been described with reference to preferred embodiments, the invention is not so limited. Many variations and modifications will occur to persons skilled in the art from a reading of the disclosure. For a definition of the invention, reference is made to the appended claims.

What I claim is:

1. A thermo-formed container comprising first and second sheet portions of a thermo-formable thermoplastic polymeric material, at least one of said first and second sheet portions having a packaging cavity therein, said first sheet portion having a tubular female element with an open end, an end wall and a side wall having female catch means arranged circumferentially thereabout extending inwardly therefrom, said second sheet portion having a tubular male element with an end wall and a side wall having male catch means arranged circumferentially thereabout extending outwardly therefrom;

the male element and female element being complimentary shaped with the female element adapted to receive the male element through the open end thereof with said male catch means in snap engagement past the female catch means with said female catch means and male catch means to engage to resist withdrawal of the male element from the female element, the female catch means and male catch means engaging each other with greatest interference over a major circumferential sector having a circumferential extent of at least 180°, a lesser circumferential sector diametrically opposite the major circumferential sector having reduced engaging interference between the male element and the female element compared to the major circumferential sector such that on insertion of the male element into the female element there is reduced resistance to the male element entering the female element over the lesser circumferential sector as compared to the major circumferential sector and, on insertion, at least on of the male element and the female element axially deflect relative to the other such that the male element moves towards the lesser circumferential section to facilitate the male catch means passing the female catch means.

2. A container as claimed in claim 1 wherein an increased space is provided between the male element and female element over the lesser circumferential section as compared with spacing between the male element and the female element over the major circumferential sector.

3. A container as claimed in claim 1 wherein said first and second sheet portions are portions of a single sheet hinged to each other to open and close the packaging cavity, and said lesser circumference section is on a side of the male and female elements remote from the hinge.

4. A package of the type made by thermo-forming synthetic resin thermoplastic material into a pair of sections adapted to close one upon the other in order to retain an object in a chamber formed therebetween, and having fastening means for securing the sections together, the improvement wherein said fastening means comprise resiliently engaging male element and female element, respectively, integrally formed with said package sections, said female element being generally cylindrical with an open end, an end wall and a generally cylindrical side wall having female catch portions arranged circumferentially thereabout extending inwardly therefrom, said male element being substantially cylindrical with an end wall and a generally cylindrical side wall having male catch means arranged circumferentially thereabout extending outwardly therefrom, the female element adapted to receive the male element through the open end thereof with said male catch means in snap engagement past the female catch means with said female catch means and male catch means to engage to resist withdrawal of the male element from the female element, wherein to facilitate passage of the male catch means past the female catch means on inserting the male element into the female element, the male element having a lesser circumferential segment provided without said male catch means extending over a continuous circumferential extent of at least 90°.

5. A package as claimed in claim 4 wherein said female catch means include female catch shoulder surfaces directed towards the end wall of the female element, said male catch means include male catch shoulder surfaces directed away from the end wall of the male element to engage the female catch shoulder surfaces and resist withdrawal of the male element from the female element.

6. A package as claimed in claim 4 wherein the male catch means comprise a plurality of enlarged diameter catch segments extending radially outwardly from the side wall of the male element spaced circumferentially with spacing between adjacent catch segments not greater than 90° other than across said lesser circumferential segment.

7. A package as claimed in claim 5 wherein said male catch shoulder surfaces and female catch shoulder surfaces are substantially coincident when in locking engagement.

8. A package as claimed in claim 4 wherein the female element side wall has an inside radius of Rfw, the female catch means have an inside radius of Rfc, the male element side wall has an exterior radius of Rfw, the male catch means have an outside radius of Rmc, and wherein Rmw is equal to or less than Rfc.

9. A package as claimed in claim 8 wherein Rmc is less than or equal to Rfw.

10. A package as claimed in claim 9 wherein Rfw is approximately equal to Rmc.

11. A package as claimed in claim 10 wherein said male catch shoulder surfaces and female catch shoulder surfaces are substantially coincident when in locking engagement.

12. A package as claimed in claim 9 wherein Rfw is approximately equal to Rmc over a portion immediately above the female catch means with said female side wall marginally reducing in diameter away from the female catch means such that the female side wall engages the male side wall and urges the male element away from the closed end of the female element to urge the female catch means and male catch portions into engagement.

13. A package as claimed in claim 4 wherein said pair of sections are directly hinged at the rear of the package.

14. A package as claimed in claim 13 wherein the lesser circumferential segment is provided on a side of the male element remote from the hinge.

15. A package as claimed in claim 1 wherein the male catch means and female catch means are disposed circumferentially about the respective side walls in a plane tilted at an angle to an axis of the male and female elements, the plane being closest to the end wall of the male element on the side of the male element where the lesser circumferential segment is provided.

16. A package as claimed in claim 4 wherein said female element has a plurality of axially extending flutes in the side wall thereof.

17. A package as claimed in claim 4 wherein said male element has a plurality of axially extending flutes in the side wall thereof.

* * * * *